US007477159B2

(12) United States Patent
Wang et al.

(10) Patent No.: US 7,477,159 B2
(45) Date of Patent: Jan. 13, 2009

(54) DETECTION DEVICE AND METHOD THEREOF

(75) Inventors: Huai-Te Wang, Kaohsiung (TW); Ching-Cheng Lin, Pingtung County (TW); Yu-Hung Sun, Kaohsiung County (TW); Makoto Huang, Kaohsiung (TW)

(73) Assignee: Hannspree Inc., Taipei (TW)

( * ) Notice: Subject to any disclaimer, the term of this patent is extended or adjusted under 35 U.S.C. 154(b) by 329 days.

(21) Appl. No.: 11/531,461

(22) Filed: Sep. 13, 2006

(65) Prior Publication Data

US 2007/0287303 A1 Dec. 13, 2007

(30) Foreign Application Priority Data

Jun. 7, 2006 (CN) ..... 2006 1 0087793

(51) Int. Cl.
*G08B 5/00* (2006.01)
*G08B 5/22* (2006.01)

(52) U.S. Cl. ..... 340/815.83; 324/770; 439/59

(58) Field of Classification Search ..... 340/815.83; 324/754, 761, 770; 439/59; 702/108, 117, 702/118

See application file for complete search history.

(56) References Cited

U.S. PATENT DOCUMENTS 6,293,804 B2 * 9/2001 Smith ..... 439/66
6,437,296 B1 * 8/2002 Choi ..... 219/444.1
7,170,311 B2 * 1/2007 Yu et al. ..... 324/770
7,355,418 B2 * 4/2008 Brunner et al. ..... 324/751
2006/0158208 A1 * 7/2006 Abboud et al. ..... 324/761
2007/0126438 A1 * 6/2007 Tang ..... 324/754
2008/0150856 A1 * 6/2008 Nam ..... 324/770

FOREIGN PATENT DOCUMENTS

CN 1051837 5/1991
CN 2765341 3/2006

OTHER PUBLICATIONS

CN Office Action mailed Sep. 26, 2008.
English Abstract of CN1051837.
English Abstract of CN2765341.

* cited by examiner

*Primary Examiner*—John A Tweel, Jr.
(74) *Attorney, Agent, or Firm*—Thomas, Kayden, Horstemeyer & Risley

(57) ABSTRACT

A connection unit utilized in detecting an electronic device, comprising a first detection board, a second detection board and a connection board. The first detection board comprises a first contact area. The second detection board comprises a second contact area. The connection board is electrically connected to the electronic device, and comprises a first signal contact area and a second signal contact area, wherein the connection board is selectively connected to the first detection board and the second detection board. When the connection board connects the first detection board, the first signal contact area is electrically connected to the first contact area. When the connection board connects the second detection board, the second signal contact area is electrically connected to the second contact area.

18 Claims, 14 Drawing Sheets

114

134

DETECTION DEVICE AND METHOD THEREOF

BACKGROUND OF THE INVENTION

1. Field of the Invention

The invention relates to a connection unit and in particular to a connection unit utilized in LCD detection.

2. Description of the Related Art

FIG. 1*a* shows a conventional LCD detection process, wherein a display 10 is disposed on a stage 1 moved by a transport device 2. The transport device 2 moves stage 1 to a first position to be detected by a first signal generator 31, and to a second position to be detected by a second signal generator 32. When the display 10 is detected by the first signal generator 31, a RF cable 21 is manually connected to a first contact 11 of the display 10, and a VGA cable 22 is manually connected to a second contact 12 to detect the display 10. With reference to FIG. 1*b*, when the display 10 is detected by the second signal generator 32, a DVI cable 23 is manually connected to a third contact 13 to detect the display 10.

First contact 11, second contact 12 and third contact 13 represent all contacts of the display 10 to simplify description. Additionally, the first signal generator and the second signal generator represent the signal generators utilized in all detection items. Practically, in LCD detection, VGA, DVI, and RF signals are utilized in various detection items. For example, assembly electrical inspection utilizes VGA signal and RF signal to perform detection, and white balance alignment utilizes DVI signal to perform detection.

Conventionally, the signal cables are manually selected and connected to the display, require time and effort. Additionally, with reference to FIGS. 1*c* and 1*d*, the signal cables (for example, RF cable 21 and VGA cable 22) are repeatedly connected to the display. With non-uniform plugging force, pins of the signal cables (for example, pins 21*a* and 22*a*) may bend or break with repeated connection.

BRIEF SUMMARY OF THE INVENTION

A detailed description is given in the following embodiments with reference to the accompanying drawings.

A connection unit utilized in detecting an electronic device, comprises a first detection board, a second detection board and a connection board. The first detection board comprises a first contact area. The second detection board comprises a second contact area. The connection board is electrically connected to the electronic device, and comprises a first signal contact area and a second signal contact area, being selectively connected to the first detection board and the second detection board. When the connection board connects to the first detection board, the first signal contact area is electrically connected to the first contact area. When the connection board connects to the second detection board, the second signal contact area is electrically connected to the second contact area.

The invention automatically connects the connection board to the first and second detection boards to transmit the first signal and the second signal. Thus, the pins of the signal cables are connected with uniform plugging force, and bending and breaking of pins thereof are prevented. Additionally, the invention utilizes different detection boards (for example, the first and second detection boards) automatically connecting the connection board to transmit different signals (for example, the first and second signals), whereby detection speed is increased.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1A:
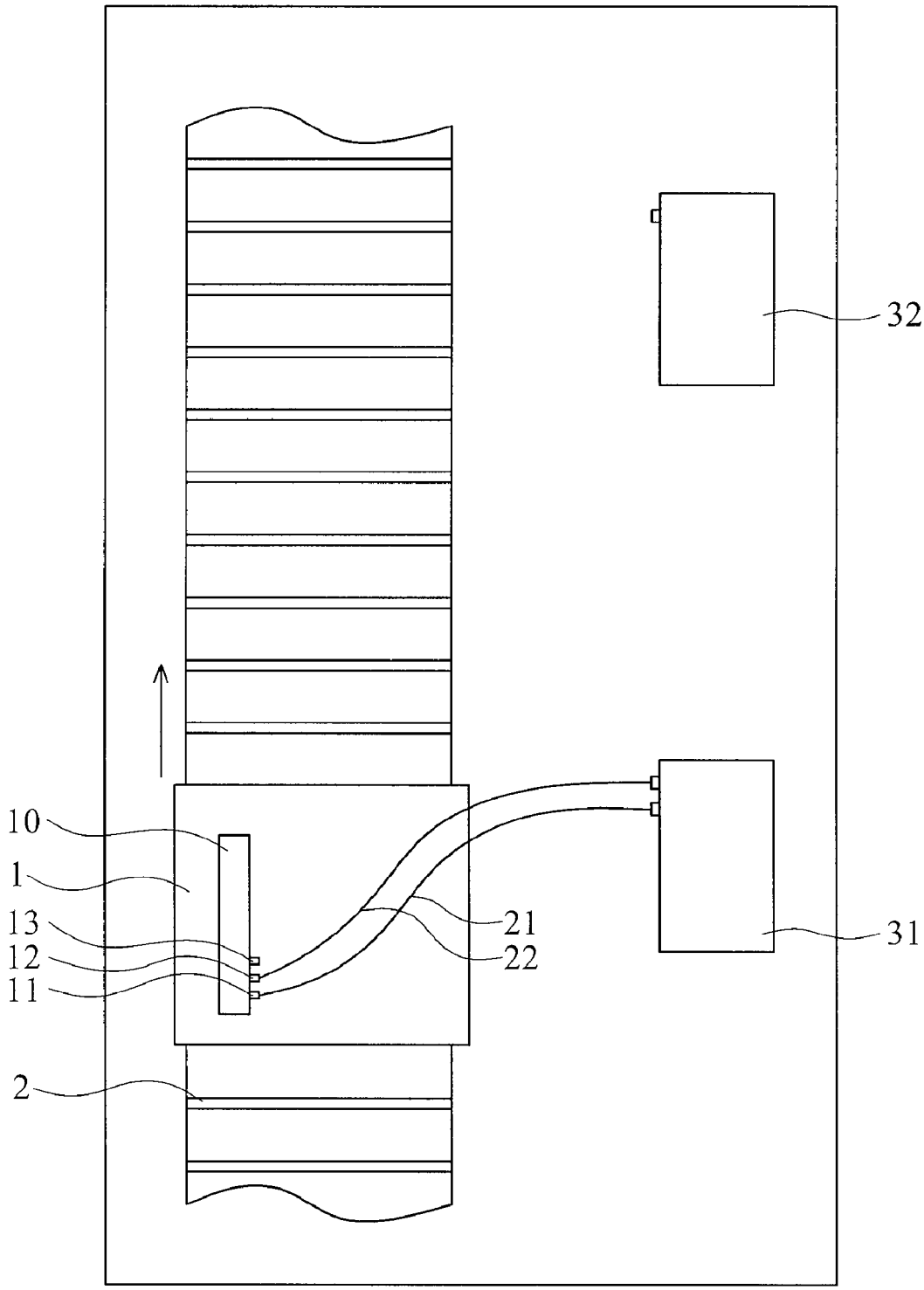
FIG. 1a (RELATED ART)
FIGS. 1*a* and 1*b* show a conventional LCD detection process.
Figure 1B:
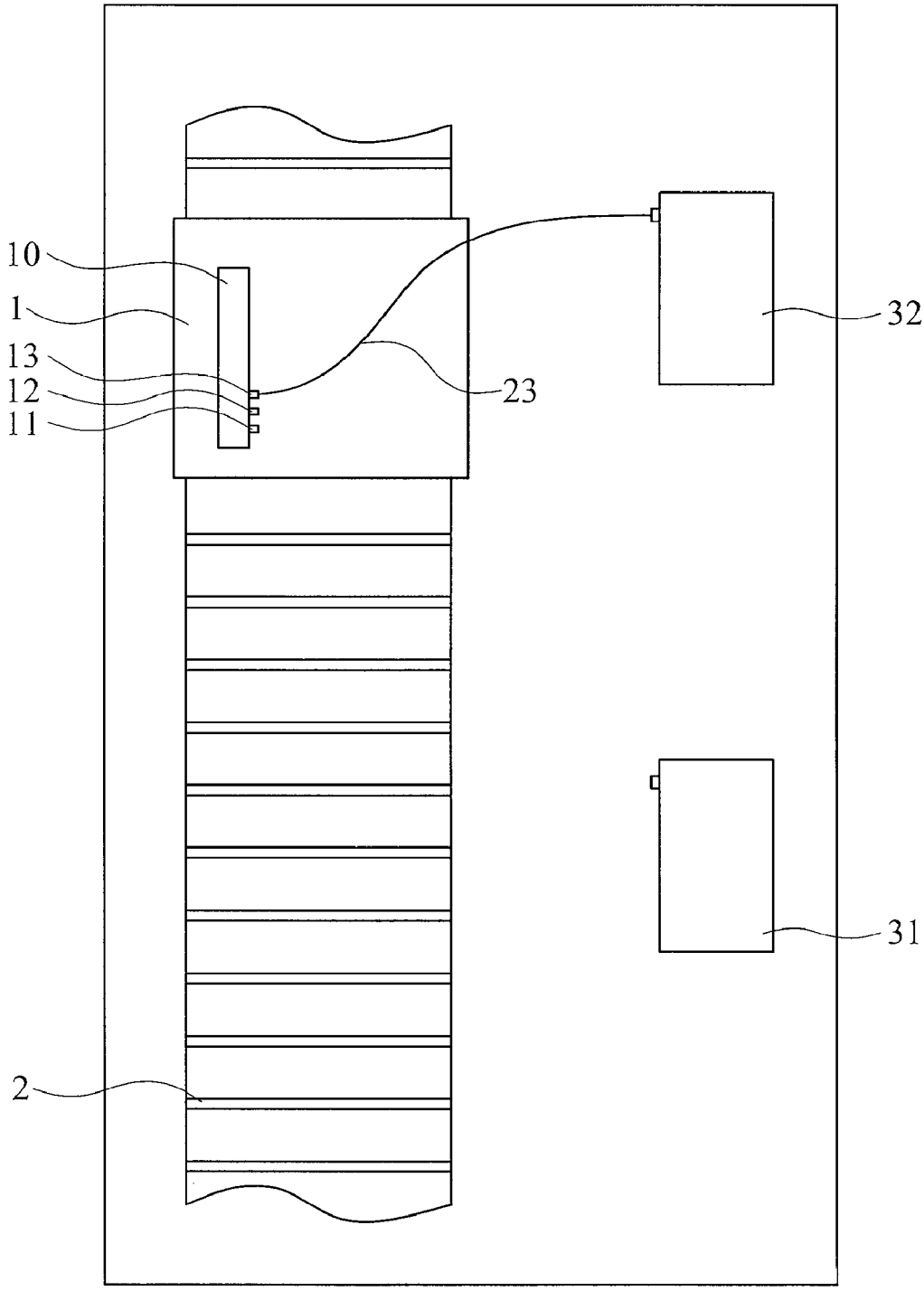
FIG. 1b (RELATED ART)
Figure 1C:
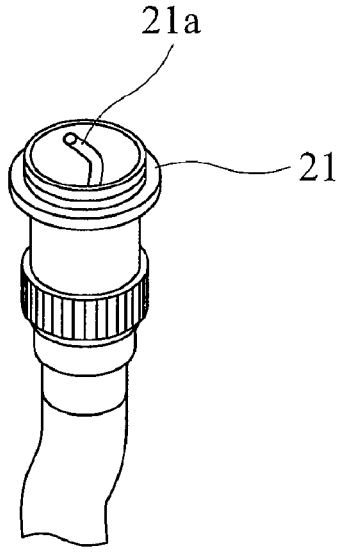
FIG. 1c (RELATED ART)
FIG. 1*c* shows a damaged RF cable.
Figure 1D:
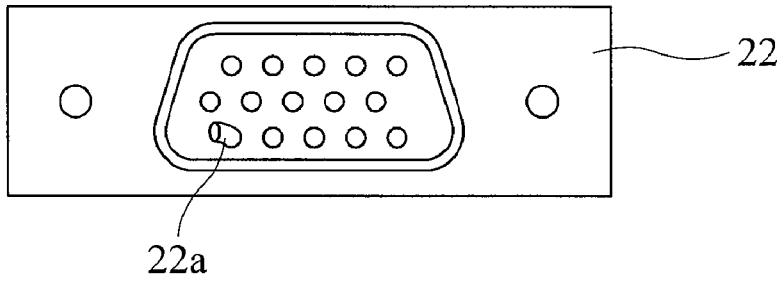
FIG. 1d (RELATED ART)
FIG. 1*d* shows a damaged VGA cable.
Figure 2A:
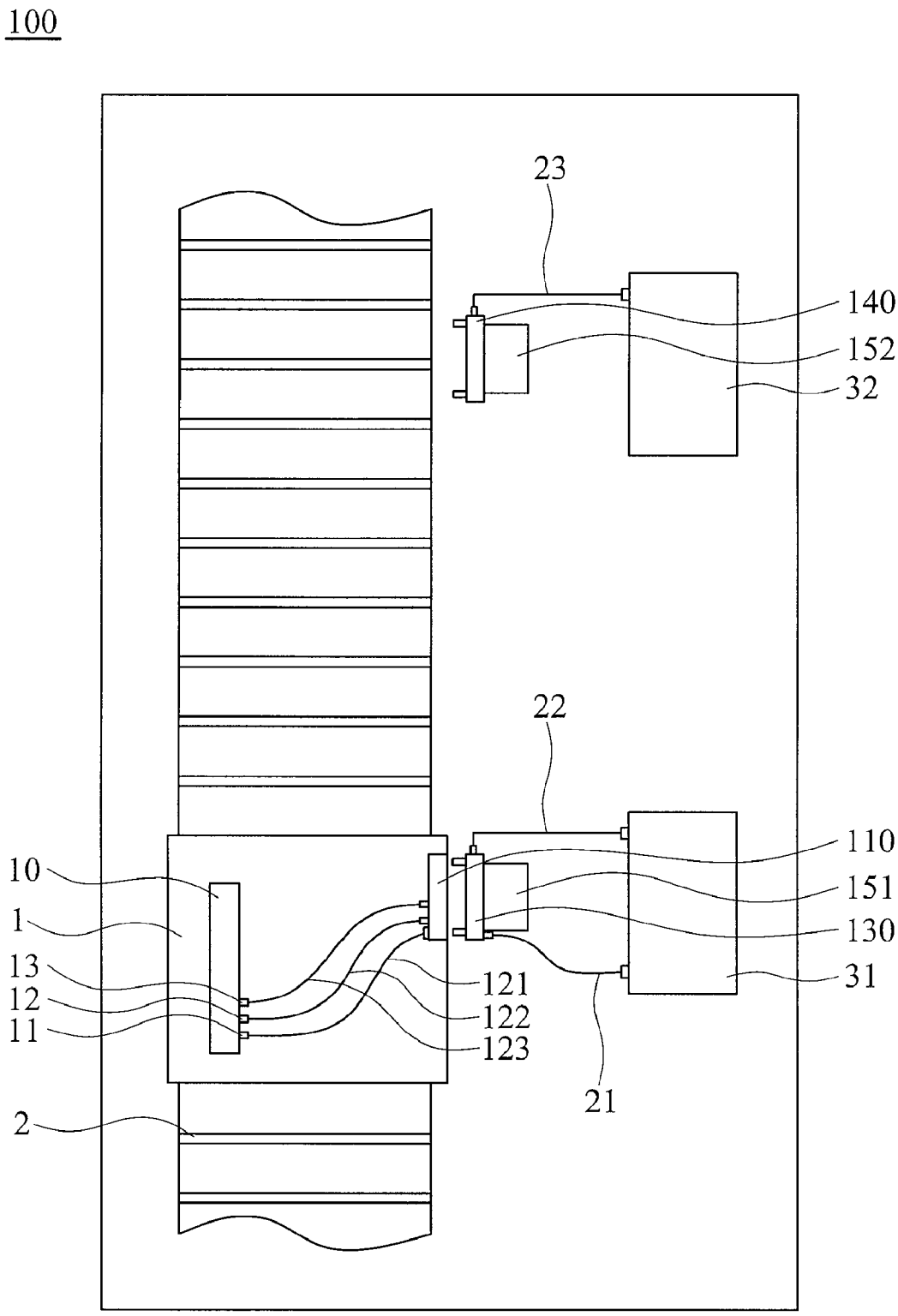
FIG. 2*a* shows detection device of the invention.

FIG. 2*a* shows a detection device 100 of the invention, comprising a stage 1, a transport device 2, a first signal generator 31, a second signal generator 32, a connection board 110, a first detection board 130, a second detection board 140, a first impeller 151 and a second impeller 152. The display (electronic device) 10 is disposed on the stage 1 transported by the transport device 2. The display 10 is coupled to the connection board 110 via a first RF cable 121 and signal cables 122 and 123. The first signal generator 31 is coupled to the first detection board 130 via a second RF cable 21 and a second VGA cable 22. The second signal generator 32 is coupled to the second detection board 140 via a DVI cable 23. The first impeller 151 is connected to the first detection board 130. The second impeller 152 is connected the second detection board 140. The display 10 comprises a plurality of contacts to transmit signals. In the disclosure, contacts 11, 12 and 13 represent all contacts of the display 10 to simplify description. The first RF cable 121 is connected to the contact 11, the second VGA cable 122 is connected to the contact 12, the signal cable 123 is connected to the contact 13, and the display is coupled to the connection board 110 thereby.

Figure 2B:
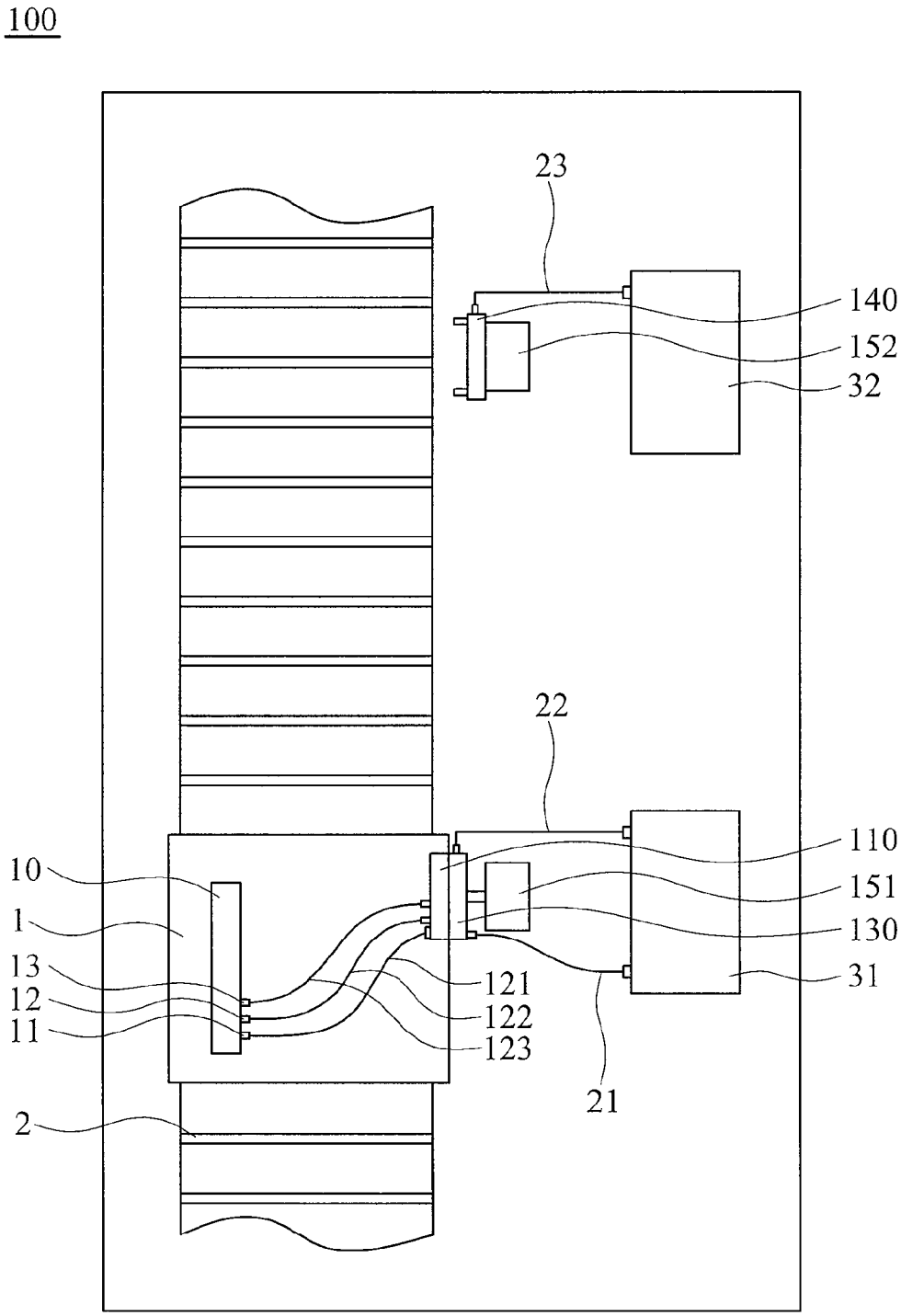
FIG. 2*b* shows a detection utilized with a first signal.

With reference to FIG. 2*b*, when a first signal (comprising, for example, VGA signal and RF signal) is utilized in detection, stage 1 is in a first position, and the first impeller 151 connects the first detection board 130 to the connection board 110. Thus, the first signal is transmitted from the first signal generator 31, passing the second RF cable 21, the second VGA cable 22, the first detection board 130, the connection board 110, the first RF cable 121 and the signal cable 122 to the display 10. Assembly electrical inspection is complete.

Figure 3A:
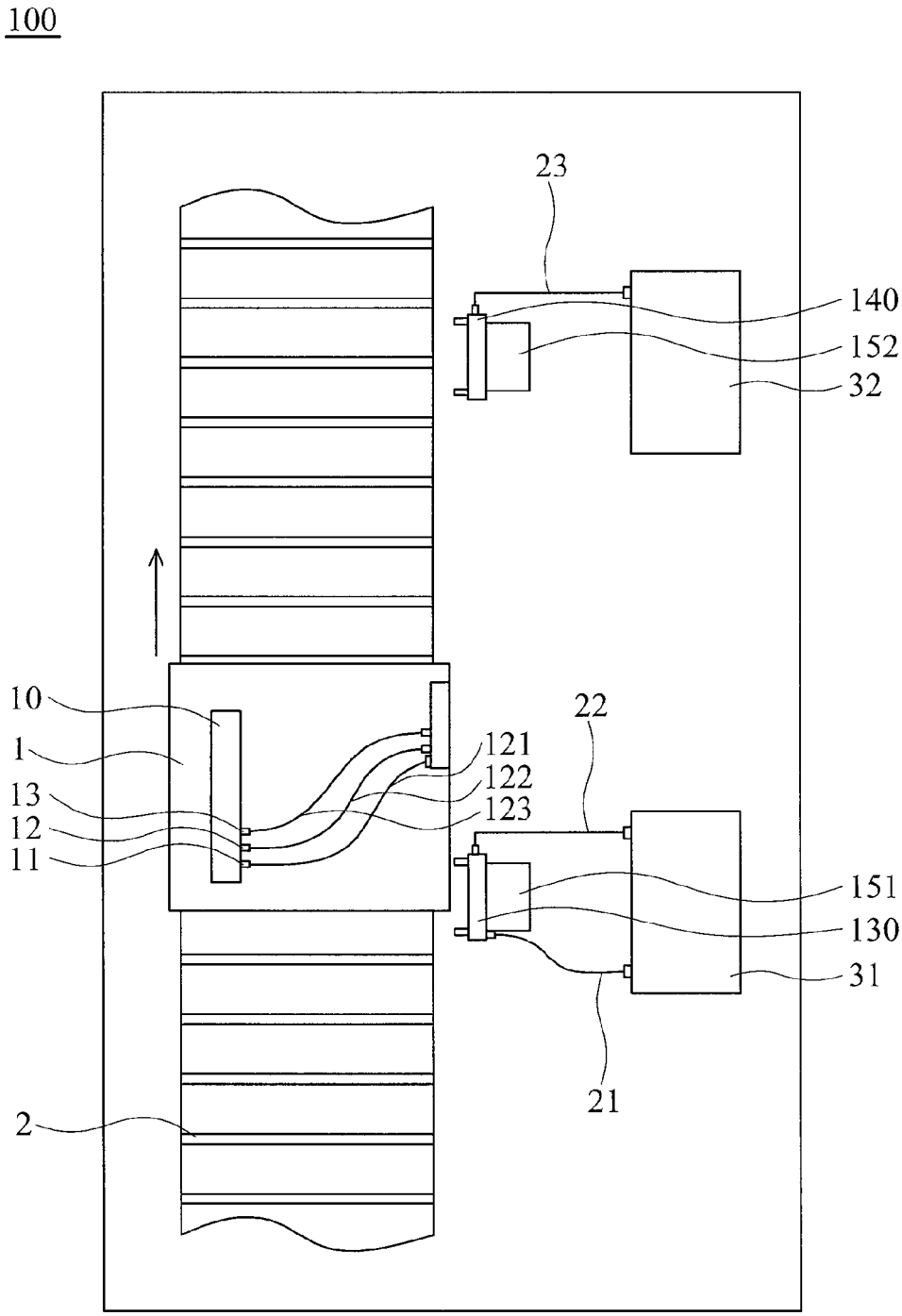
FIG. 3*a* shows a display moved by a transport device.

With reference to FIG. 3*a*, after the first detection (assembly electrical inspection) is complete, the first impeller 151 separates the first detection board 130 from the connection board 110, and stage 1 is moved from the first position to a second position by the transport device 2.

Figure 3B:
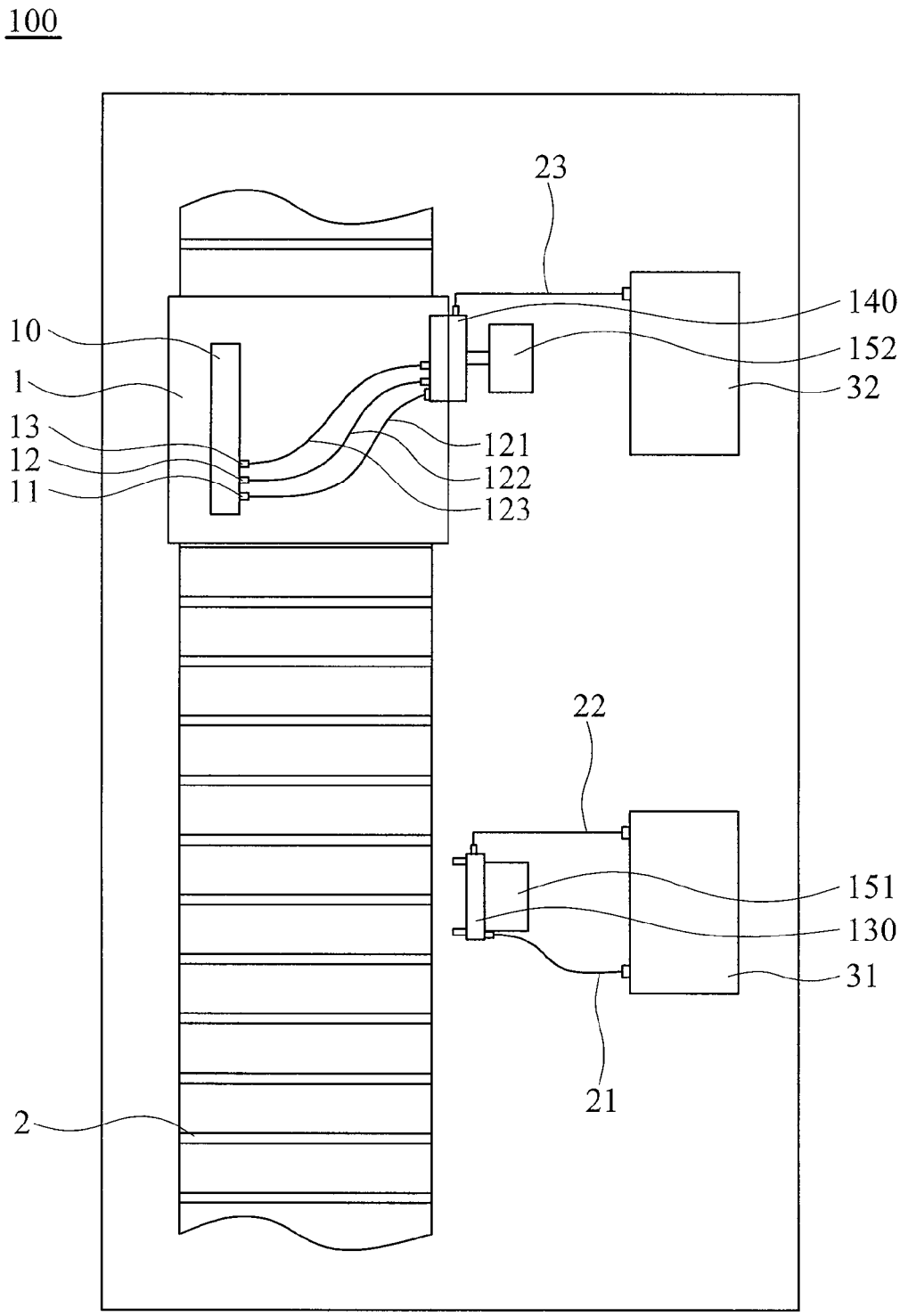
FIG. 3*b* shows a detection utilized with a second signal.

With reference to FIG. 3*b*, when a second signal (comprising, for example, DVI signal) is utilized in detection, stage 1 is in the second position, and the second impeller 152 connects the second detection board 140 to the connection board 110. Thus, the second signal is transmitted from the second signal generator 32, passing the DVI cable 23, the second detection board 140, the connection board 110 and the signal cable 123 to the display 10. Thus, white balance alignment is performed.

The invention automatically connects the connection board to the first and second detection boards to transmit the first signal and the second signal. Thus, the plugs of the signal cables are connected with uniform plugging force, and bending and breaking of pins thereof are prevented. Additionally, the invention utilizes different detection boards (for example, the first and second detection boards) automatically connecting the connection board to transmit different signals (for example, the first and second signals), such that detection speed is increased.

The first impeller 151 and the second impeller 152 are cylinders.

Figure 4A:
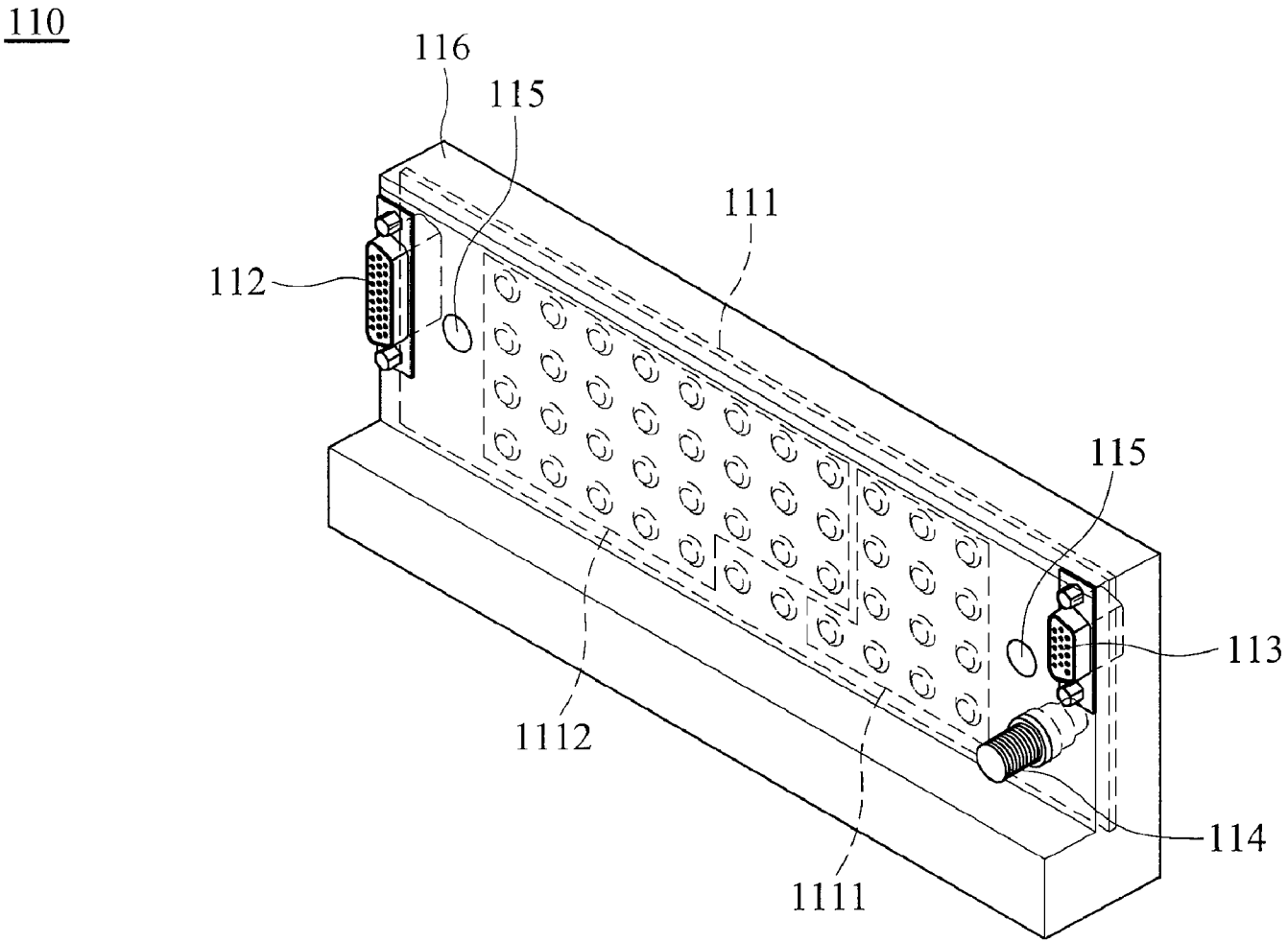
FIG. 4*a* shows a detailed structure of a connection board.

FIG. 4*a* shows a detailed structure of the connection board 110, comprising a connection circuit board 111, a first signal contact area 1111, a second signal contact area 1112, a first connection port 112, a second connection port 113, a first connector 114, positioning holes 115 and a connector body 116. The connection ports 112 and 113 are disposed on the connection circuit board 111. The VGA signal and the DVI signal are transmitted via the first signal contact area 1111 and the second signal contact area 1112. The first connector 114 transmits the RF signal. The connection circuit board 111 and the first connector 114 are disposed in the connector body 116. The positioning holes 115 pass the body 116.

Figure 4B:
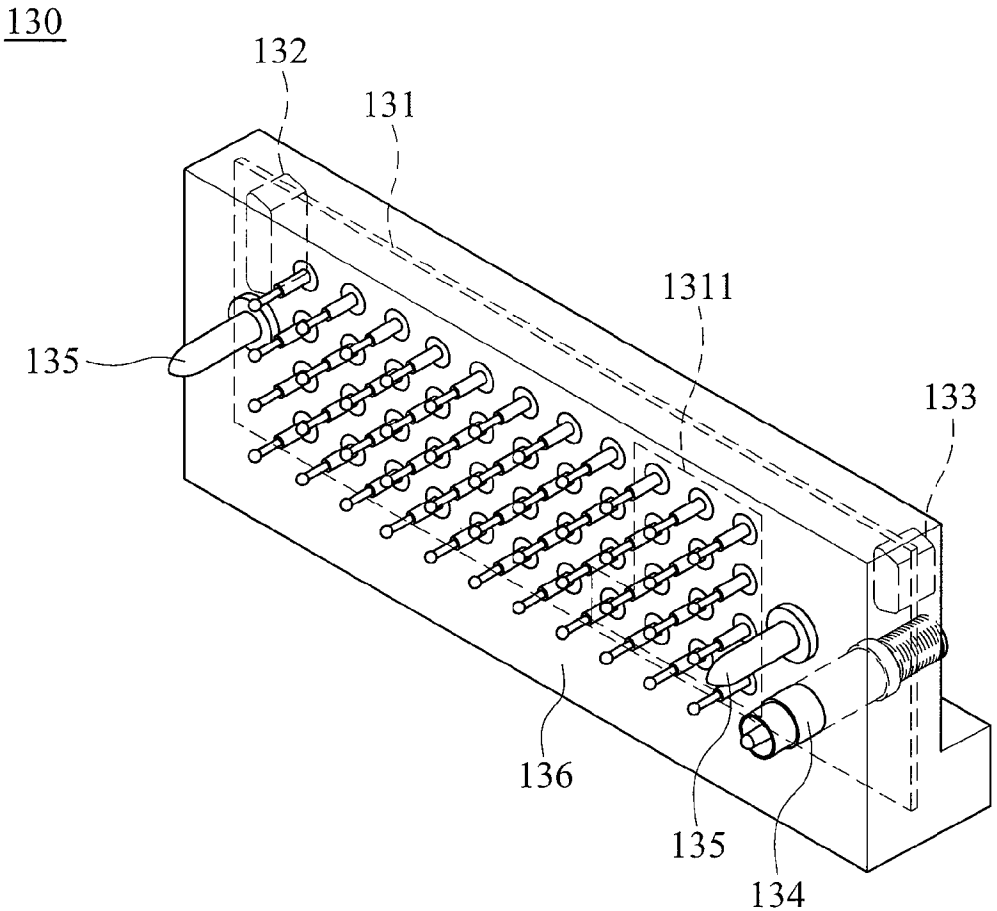
FIG. 4*b* shows a detailed structure of a first connection board.

FIG. 4*b* shows a detailed structure of the first detection board 130, utilized in assembly electrical inspection to transmit the VGA signal and the RF signals. The first detection board 130 comprises a detection circuit board 131, a first connection area 1311, a first connection port 132, a second connection port 133, a second connector 134, first position posts 135 and a first detection body 136. The connection ports 132 and 133 are disposed on the first detection circuit board 131. The VGA signal is transmitted via the first contact area 1311, comprising a plurality of pins. The second connector 134 transmits RF signal. The first detection circuit board 131 and the second connector 134 are disposed in the first detection body 136, and the first positioning posts 135 are disposed on the first detection body 136.

Figure 4C:
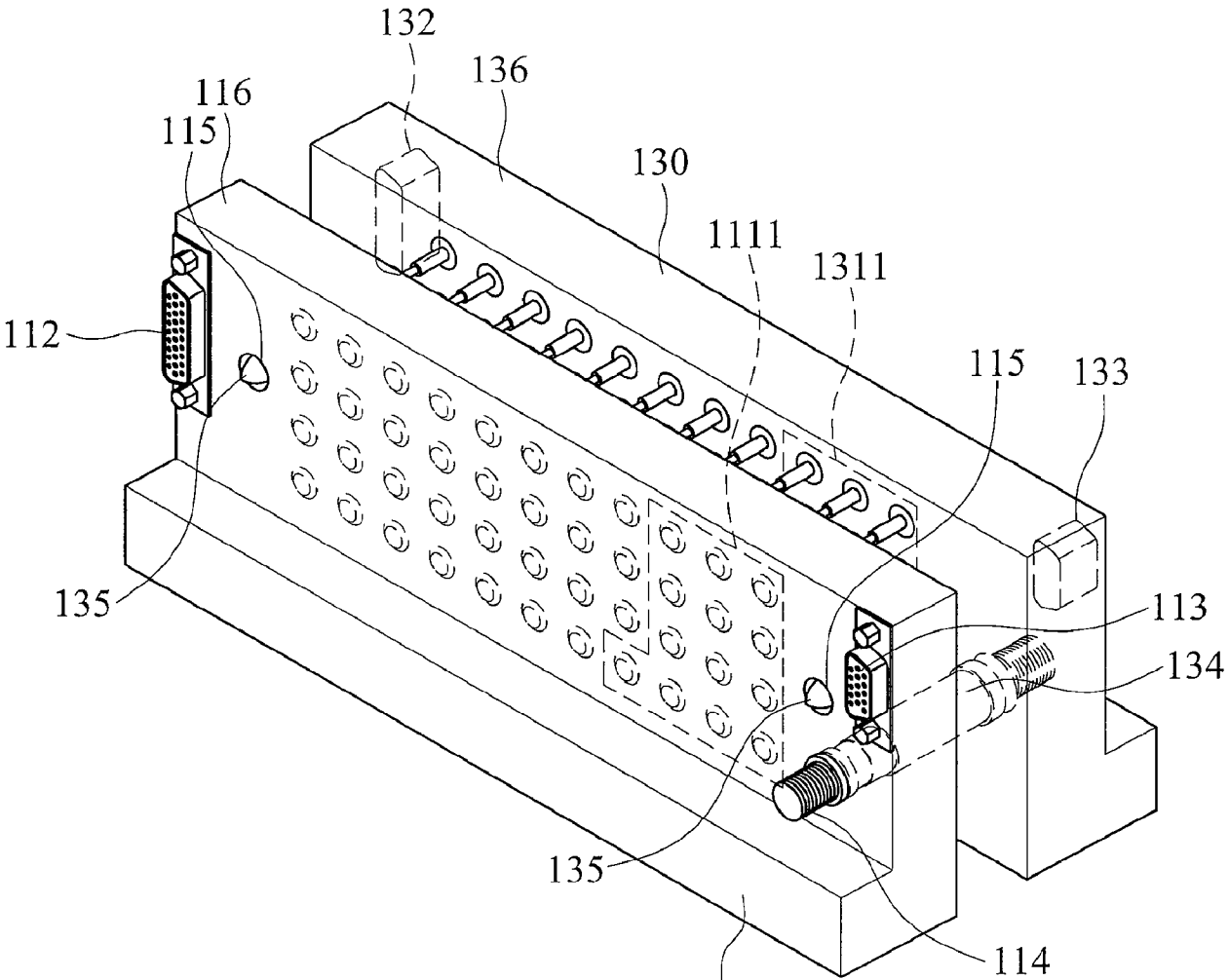
FIG. 4*c* shows the connection board connecting to the first connection board.

With reference to FIG. 4*c*, when the connection board 110 is connected to the first detection board 130, the first contact area 1311 is coupled to the first signal contact area 1111 to transmit the VGA signal. The first positioning posts 135 are inserted into the positioning holes 115. The second connector 134 is coupled to the first connector 114 to transmit the RF signal. Thus, the VGA and RF signals are transmitted to the display to perform the assembly electrical inspection.

Figure 5A:
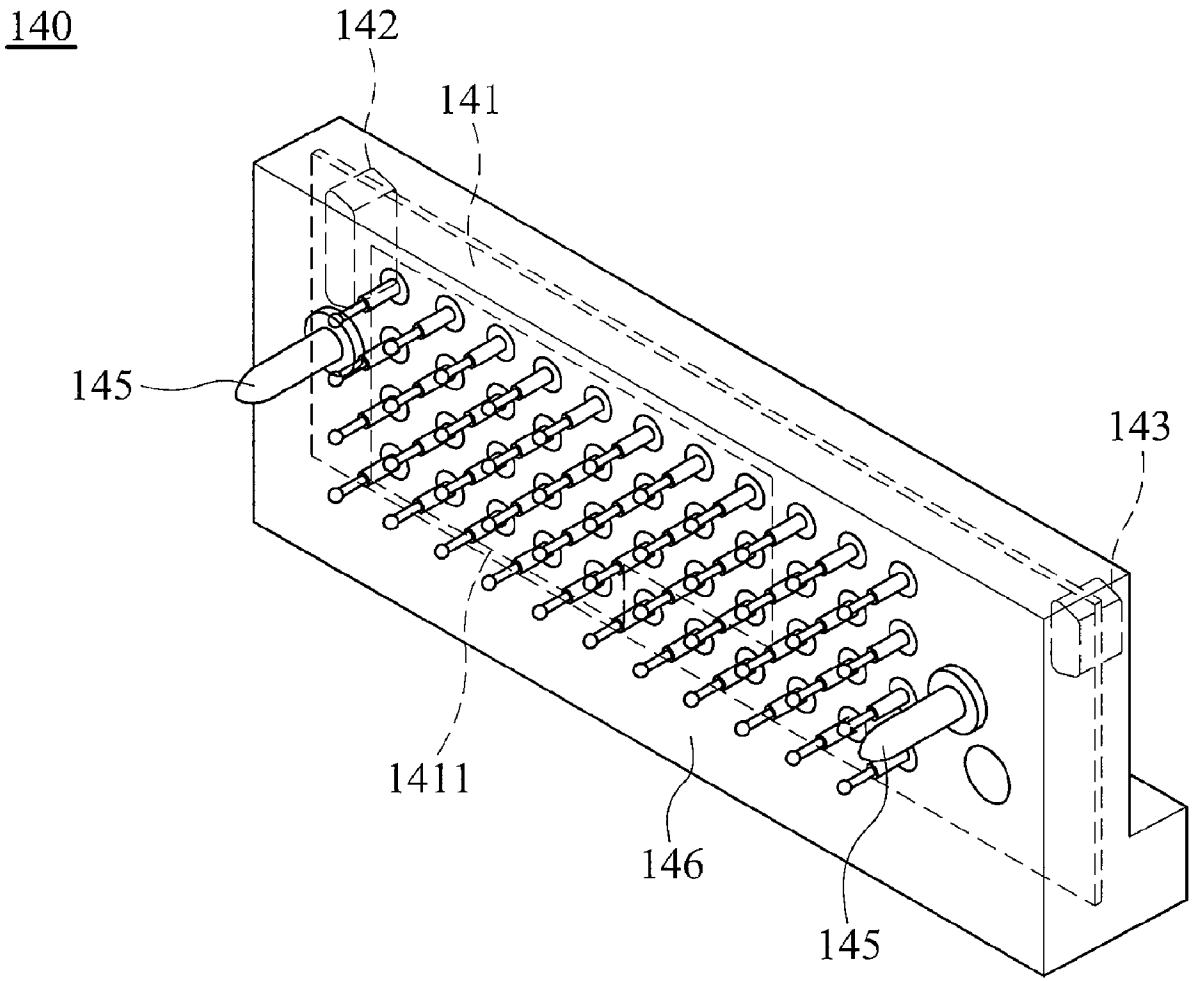
FIG. 5*a* shows a detailed structure of a second connection board.

FIG. 5*a* shows a detailed structure of the second detection board 140, utilized in white balance alignment, and transmits the DVI signal. The second detection board 140 comprises a second detection circuit board 141, a second connection area 1411, a third connection port 142, a fourth connection port 143, second position posts 145 and a second detection body 146. The connection ports 142 143 are disposed on the second detection circuit board 141. The DVI signal is transmitted via the second contact area 1411, which comprises a plurality of pins. The second detection circuit board 141 and the second positioning post 145 are disposed in the second detection body 146.

Figure 5B:
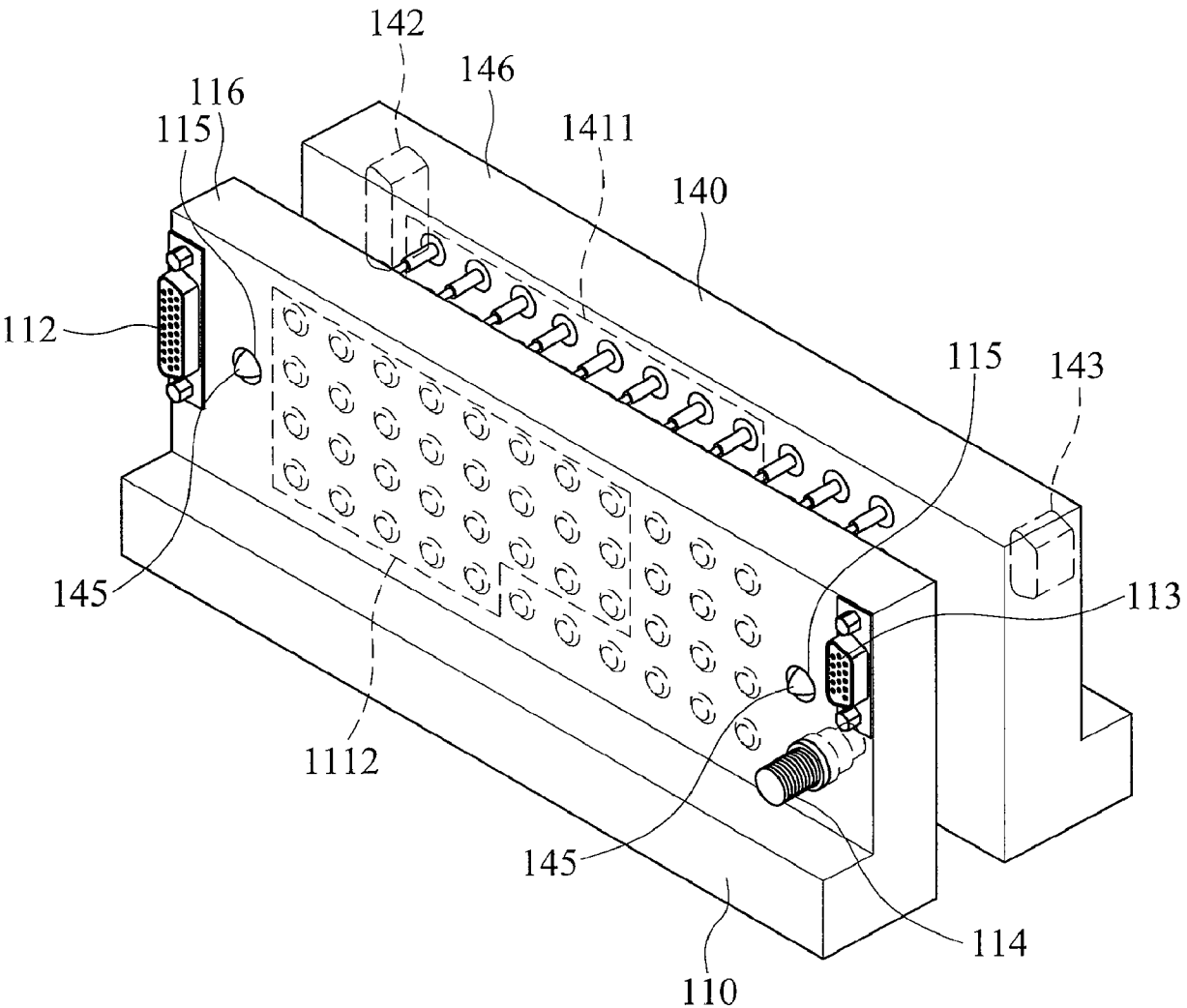
FIG. 5*b* shows the connection board connecting to the second connection board.

With reference to FIG. 5*b*, when the connection board 110 is connected to the second detection board 140, the second contact area 1411 is coupled to the second signal contact area 1112 to transmit the DVI signal. The second positioning posts 145 are inserted into the positioning holes 115. Thus, the DVI signal is transmitted to the display to perform the white balance alignment.

In this embodiment, the first detection board 130 and the second detection board 140 are utilized in assembly electrical inspection and white balance alignment. However, the detection items of the display further comprise RF sound detection, positioning alignment, and others. This design of the detection boards and the signal transmission method, are not, however, intended to limit the invention.

Figure 6A:
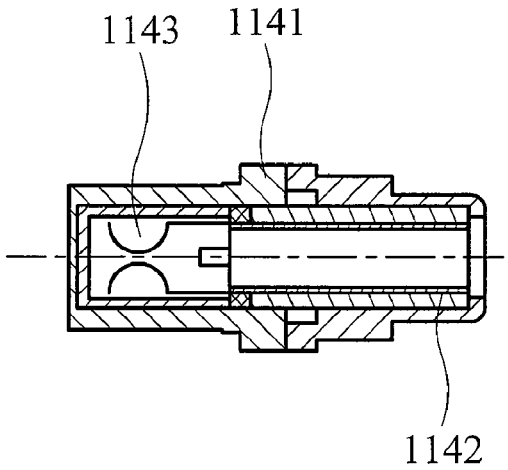
FIG. 6*a* shows a detailed structure of a first connector.

FIG. 6*a* shows a detailed structure of the first connector 114, comprising a housing 1141, a telescoping portion 1142 and a coupling portion 1143. The telescoping portion 1142 and the coupling portion 1143 are located in the housing 1141.

Figure 6B:
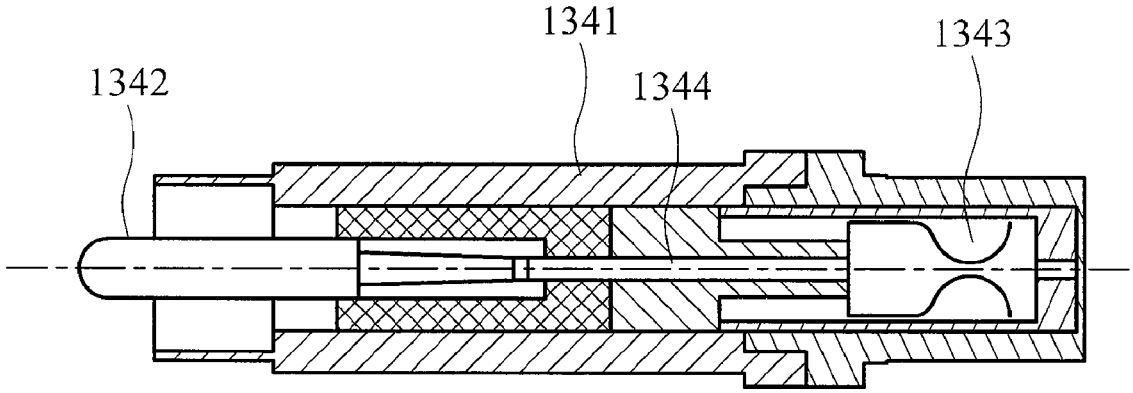
FIG. 6*b* shows a detailed structure of a second connector.

FIG. 6*b* shows a detailed structure of the second connector 134, comprising a housing 1341, a pin 1342, a coupling portion 1343 and a conduction element 1344. The pin 1342, the coupling portion 1343 and the conduction element 1344 are located in the housing 1341. The conduction element 1344 couples the pin 1342 to the coupling portion 1343.

Figure 6C:
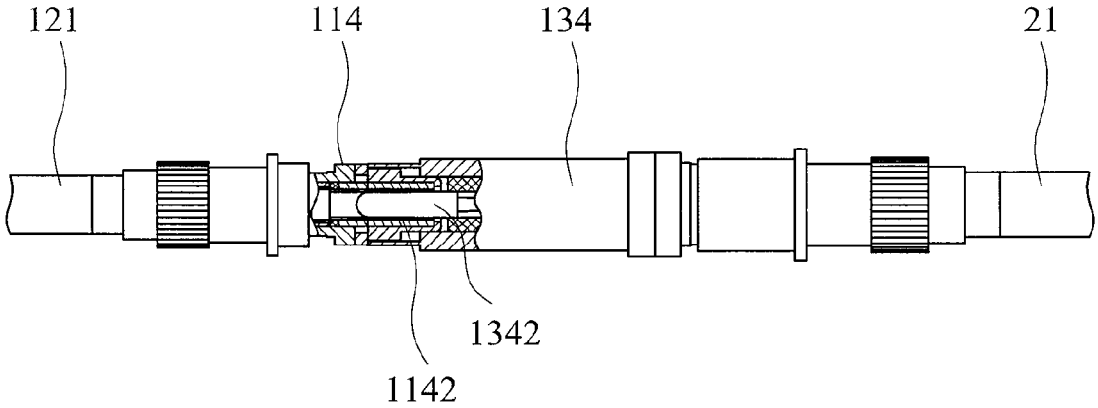
FIG. 6*c* shows the first connector connecting to the second connector.

With reference to FIG. 6*c*, when the connection board 110 is connected to the first detection board 130, the second connector 134 is coupled to the first connector 114. The second connector 134 is coupled to the first signal generator 31 via the RF cable 21. The first connector 114 is coupled to the display 10 via the RF cable 121. The RF signal is emitted from the first signal generator 31, passes the RF cable 21, the pin 1342, the telescoping portion 1142, the RF cable 121, and enters the display 10. The diameter of the pin 1342 is greater than 1 mm, particularly 4 mm. The pin 1342 is thicker than a copper line of conventional RF cable. Thus, the pin 1342 can be repeatedly coupled to the display without damage. The cost of the detection element is thus reduced.

The invention further relates to a connection unit comprising a first detection board, a second detection board, and a connection board. The first detection board comprises a first contact area. The second detection board comprises a second contact area. The connection board is electrically connected to the electronic device, comprising a first signal contact area and a second signal contact area, wherein the connection board is selectively connected to the first detection board and the second detection board. When the connection board connects to the first detection board, the first signal contact area is electrically connected to the first contact area. When the connection board connects to the second detection board, the second signal contact area is electrically connected to the second contact area.

While the invention has been described by way of example and in terms of preferred embodiment, it is to be understood that the invention is not limited thereto. To the contrary, it is intended to cover various modifications and similar arrangements (as would be apparent to those skilled in the art). Thus, the scope of the appended claims should be accorded the broadest interpretation so as to encompass all such modifications and similar arrangements.

What is claimed is:

1. A connection unit, comprising:

a first detection board, comprising a first contact area;

a second detection board, comprising a second contact area; and a connection board, electrically connected to an electronic device, the connection board comprising a first signal contact area and a second signal contact area, wherein the connection board is selectively connected to the first detection board and the second detection board, wherein when the connection board connects to the first detection board, the first signal contact area is electrically connected to the first contact area, and when the connection board connects to the second detection board, the second signal contact area is electrically connected to the second contact area.

2. The connection unit as claimed in claim 1, further comprising a signal cable electrically connected to the electronic device and the connection board.

3. The connection unit as claimed in claim 2, wherein the connection board further comprises a first connector electrically connected to the signal cable, the first detection board comprises a second connector connected to the first connector, the second connector comprises a pin inserted into the first connector, and a diameter of the pin is greater than 1 mm.

4. The connection unit as claimed in claim 3, wherein the diameter of pin is 4 mm.

5. The connection unit as claimed in claim 2, wherein the connection board is electrically connected to the signal cable, when the connection board is connected to the first detection board, a first signal passes through the first contact area, the first signal contact area, and the signal cable to the electronic device, and when the connection board is connected to the second detection board, a second signal passes through the second contact area, the second signal contact area, and the signal cable to the electronic device.

6. A detection device, comprising:

a first signal generator, generating a first signal;

a first detection board, comprising a first contact area, and the first detection board is electrically connected to the first signal generator;

a second signal generator, generating a second signal;

a second detection board, comprising a second contact area, and the second detection board is electrically connected to the second signal generator; and a connection board, electrically connected to an electronic device, the connection board comprising a first signal contact area and a second signal contact area, wherein the connection board is selectively connected to the first detection board and the second detection board, wherein when the connection board connects to the first detection board, the first signal contact area is electrically connected to the first contact area, and the first signal passes through the first contact area and the first signal contact area to the electronic device; when the connection board connects the second detection board, the second signal contact area is electrically connected to the second contact area, and the second signal passes through the second contact area and the second signal contact area to the electronic device.

7. The detection device as claimed in claim 6, further comprising a first impeller and a second impeller, the first impeller connected to the first detection board, the second impeller connected to the second detection board, wherein when the connection board is in a first position, the first impeller forces the first detection board to connect the connection board, and when the connection board is in a second position, the second impeller forces the second detection board to connect the connection board.

8. The detection device as claimed in claim 7, wherein the first impeller and the second impeller are cylinders.

9. The detection device as claimed in claim 6, wherein the connection board comprises a positioning hole, the first detection board comprises a first positioning post, the second detection board comprises a second positioning post, when the connection board connects the first detection board, the first positioning post is inserted into the positioning hole, and when the connection board connects the second detection board, the second positioning post is inserted into the positioning hole.

10. The detection device as claimed in claim 6, further comprising a signal cable coupling the electronic device to the connection board.

11. The detection device as claimed in claim 6, wherein the first signal comprises a VGA signal.

12. The detection device as claimed in claim 6, wherein the first signal comprises a RF signal.

13. The detection device as claimed in claim 6, wherein the second signal comprises a DVI signal.

14. A detection method, comprising:

providing a detection device comprising a first signal generator, a first detection board, a second signal generator, a second detection board, a signal cable and a connection board, wherein the first signal generator is coupled to the first detection board, the second signal generator is coupled to the second detection board, and an electronic device couples to the connection board via the signal cable;

connecting the connection board to the first detection board, wherein a first signal is emitted from the first signal generator, passing through the first detection board, the connection board and the signal cable, and transmitted to the electronic device;

separating the connection board from the first detection board; and connecting the connection board to the second detection board, wherein a second signal is emitted from the second signal generator, passing through the second detection board, the connection board and the signal cable, and transmitted to the electronic device.

15. The detection method as claimed in claim 14, further comprising moving the connection board to a first position to connect the first detection board.

16. The detection method as claimed in claim 15, further comprising moving the connection board to a second position to connect the second detection board.

17. The detection method as claimed in claim 15, wherein the first detection board and the second detection board are connected to the connection board automatically.

18. The detection method as claimed in claim 15, wherein the electronic device is a liquid crystal display.

* * * * *